US006730009B2

(12) United States Patent
Tuyuki et al.

(10) Patent No.: US 6,730,009 B2
(45) Date of Patent: May 4, 2004

(54) SHEET MEMBER GUIDE MECHANISM HAVING A FABRIC TUBE FITTED OVER A ROLLER CORE

(75) Inventors: Mikio Tuyuki, Minamiashigara (JP); Iwao Sugizaki, Minamiashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 238 days.

(21) Appl. No.: 09/984,840

(22) Filed: Oct. 31, 2001

(65) Prior Publication Data

US 2002/0050682 A1 May 2, 2002

(30) Foreign Application Priority Data

Oct. 31, 2000 (JP) ..... 2000-333247

(51) Int. Cl.[7] ..... B65H 27/00; F16C 13/00

(52) U.S. Cl. ..... 492/55; 492/29; 226/193

(58) Field of Search ..... 492/28, 29, 55; 242/615.2, 615.4; 226/186, 190, 193; 101/142, 420; 396/614, 620; 134/64 P

(56) References Cited

U.S. PATENT DOCUMENTS

| | | | | | |
|---|---|---|---|---|---|
| 2,085,845 | A | * | 7/1937 | Binkley et al. | 492/4 |
| 2,704,392 | A | * | 3/1955 | Schultz | 492/4 |
| 2,840,888 | A | * | 7/1958 | Guglielmo et al. | 492/25 |
| 3,710,470 | A | * | 1/1973 | Krake | 492/55 |
| 4,098,631 | A | * | 7/1978 | Stryjewski | 156/221 |
| 4,125,851 | A | * | 11/1978 | Krehbiel | 396/614 |
| 4,317,270 | A | * | 3/1982 | Watanabe et al. | 29/447 |
| 4,759,284 | A | * | 7/1988 | Haggard et al. | 101/148 |
| 4,944,089 | A | * | 7/1990 | Flamig et al. | 29/895.22 |
| 4,977,828 | A | * | 12/1990 | Douglas | 101/142 |

FOREIGN PATENT DOCUMENTS

| | | | | |
|---|---|---|---|---|
| JP | 5-237541 | * | 9/1993 | 242/615.2 |

* cited by examiner

*Primary Examiner*—Donald P. Walsh
*Assistant Examiner*—Daniel K Schlak
(74) *Attorney, Agent, or Firm*—Sughrue Mion, PLLC

(57) ABSTRACT

A guide roller has a hollow roller and a fabric tube fitted under pressure over the hollow roller. The fabric tube has ends held respectively in axial ends of the hollow roller and fixed thereto by respective pressers which are pressed into the axial ends of the hollow roller.

4 Claims, 4 Drawing Sheets

SHEET MEMBER GUIDE MECHANISM HAVING A FABRIC TUBE FITTED OVER A ROLLER CORE

BACKGROUND OF THE INVENTION

1. Field of the Invention

The present invention relates to a sheet member guide mechanism having a guide roller for guiding a sheet member.

2. Description of the Related Art

There is known a system for recording radiation image information of a subject such as a human body with a stimulate phosphor, and reproducing the recorded radiation image information on a photosensitive medium such as a photographic film, or displaying the recorded radiation image information on a display unit such as a CRT or the like.

The stimulate phosphor is a phosphor which, when exposed to a radiation (X-rays, α-rays, γ-rays, electron beams, ultraviolet radiation, or the like), stores a part of the energy of the radiation, and, when subsequently exposed to stimulating rays such as visible light, emits light in proportion to the stored energy of the radiation. Usually, a sheet provided with a layer of the stimulate phosphor is used as a stimulate phosphor sheet.

The above known system includes an image information reading apparatus which comprises a reading unit for reading the recorded radiation image information carried on the stimulate phosphor sheet, and an erasing unit for erasing residual radiation image information remaining on the stimulate phosphor sheet after the recorded radiation image information has been read from the stimulate phosphor sheet. The image information reading apparatus also includes a loading unit for accommodating a cassette which stores a stimulate phosphor sheet with the radiation image information of a subject being recorded thereon by an external exposure device.

When the cassette is opened, a sheet picking mechanism removes the stimulate phosphor sheet from the cassette, and the stimulate phosphor sheet is fed to the reading unit by a sheet feed mechanism. The reading unit reads the recorded radiation image information from the stimulate phosphor sheet. Thereafter, the erasing unit erases residual radiation image information from the stimulate phosphor sheet, which is then stored back into the cassette in the loading unit.

There has recently been a demand for efficiently reading the energy stored in a stimulate phosphor sheet in order to reproduce the recorded radiation image information of a subject with high image quality. Such a demand is particularly growing in the field of mammography or the like. One attempt to meet the demand is to use a transparent base in a stimulate phosphor sheet. When stimulating light is applied to the outer surface of a phosphor layer (recording surface) of the stimulate phosphor sheet, light is emitted from both surfaces of the phosphor sheet, i.e., light is emitted is from the outer surface of the phosphor layer and the outer surface of the transparent base (reverse surface). Therefore, the stimulate phosphor sheet serves as a double-side-readable stimulate phosphor sheet.

The sheet feed mechanism employs a roller for preventing the stimulate phosphor sheet from rising off a curved feed path to smoothly guide the stimulate phosphor sheet along the curved feed path. The roller has a damping member applied to an area thereof which will be contacted by the reverse surface or recording surface of the stimulate phosphor sheet. The damping member is effective to prevent the reverse surface or recording surface of the stimulate phosphor sheet from being damaged by contact with the roller.

The damping member is attached to the roller by an adhesive tape or the like. However, the adhesive tape fails to keep the damping member bonded smoothly to the entire surface of the roller. In order to bond the damping member smoothly to the entire surface of the roller, it is necessary to repeatedly detach and bond the damping member. As a result, the process of attaching the damping member appropriately to the roller is considerably complex.

SUMMARY OF THE INVENTION

It is therefore an object of the present invention to provide a sheet member guide mechanism which has a simple structure and is capable of feeding a sheet member smoothly and reliably along a desired feed path without causing damage to the sheet member.

According to the present invention, there is provided a sheet member guide mechanism comprising a guide roller for guiding a sheet member which is being fed, the guide roller comprising a roller core and a fabric tube fitted under pressure over the roller core. Since it is not necessary to attach the fabric tube to the outer circumferential surface of the roller core by an adhesive tape or the like, the guide roller can be assembled highly efficiently. The fabric tube is woven or knit of fibers such as nylon filaments or the like, so that there is no joint formed in the outer circumferential surface of the fabric tube, and hence the fabric tube which is held against a sheet member does not cause damage to the sheet member.

The sheet member guide mechanism also has a pair of pressers mounted respectively in axial ends of the roller core to hold and secure respective ends of the fabric tube in the axial ends of the roller core. The ends of the fabric tube are kept out of sliding contact with the sheet member, and are prevented from being unraveled.

The roller core comprises a hollow roller which is rotatably supported on a shaft by a pair of bearings. Therefore, even if foreign deposits such as dust particles are applied to the fabric tube, since the fabric tube does not slide against the sheet member, the sheet member is effectively prevented from being damaged by those foreign deposits.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
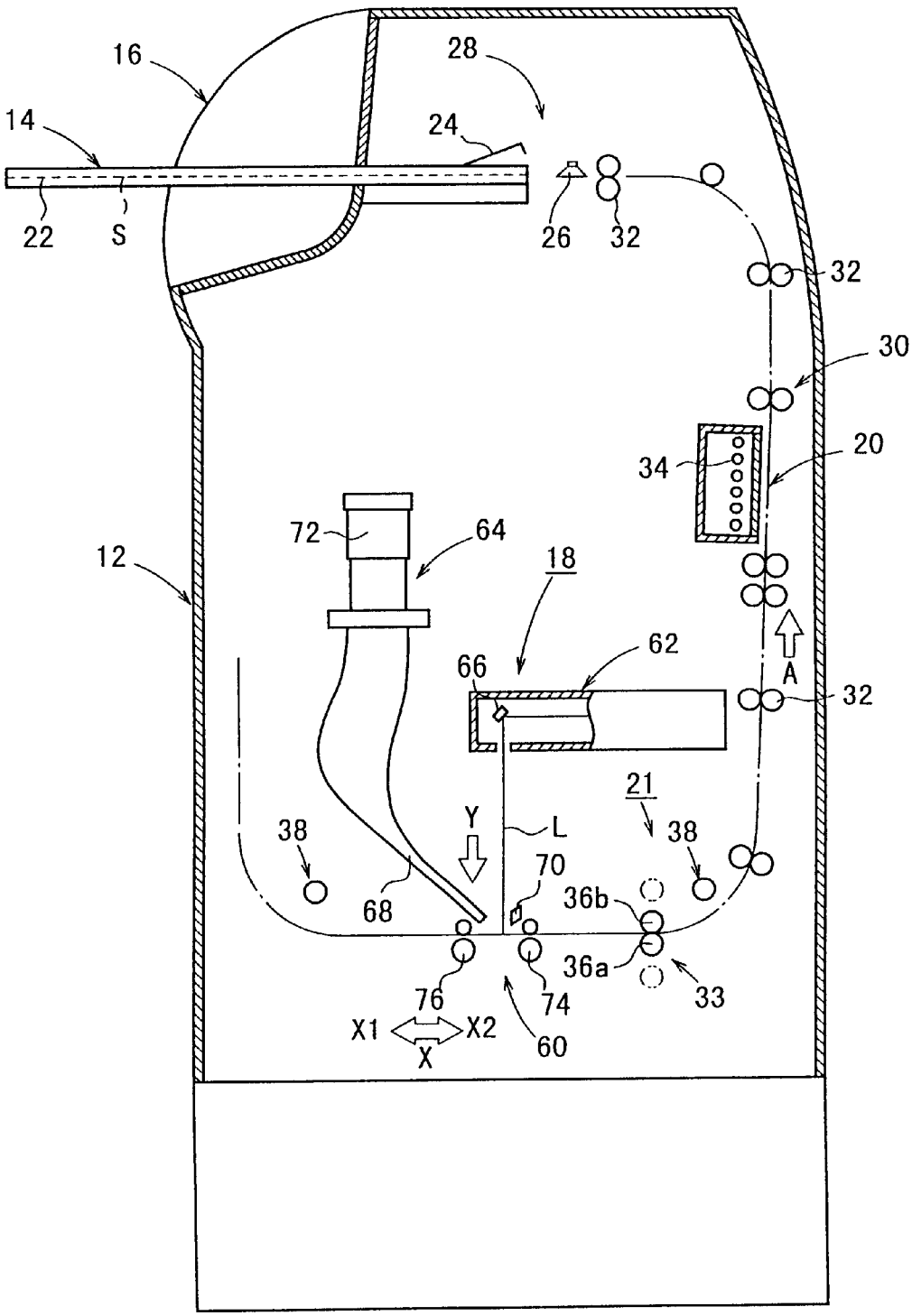
FIG. 1 is a vertical cross-sectional view of an image information reading apparatus which incorporates a sheet member guide mechanism according to the present invention.

FIG. 1 shows in vertical cross section an image information reading apparatus 10 which incorporates a sheet member guide mechanism according to the present invention.

As shown in FIG. 1, the image information reading apparatus 10 has an apparatus housing 12 which houses therein a cassette loading unit 16 for loading a cassette 14 which stores therein a stimulable phosphor sheet S as a sheet-like recording medium on which the radiation image information of a subject or the like is temporarily recorded, a reading unit 18 for applying a laser beam L as stimulating light to the stimulable phosphor sheet S to photoelectrically read the recorded radiation image information from the stimulable phosphor sheet S, an erasing unit 20 for erasing residual radiation image information from the stimulable phosphor sheet S after the desired recorded radiation image information has been read from the stimulable phosphor sheet S, and a sheet member guide mechanism 21 disposed near the reading unit 18.

The cassette 14 comprises a casing 22 for housing the stimulable phosphor sheet S therein, and a lid 24 openably and closably mounted on an end of the casing 22 for allowing the stimulable phosphor sheet S to be removed from and inserted into the casing 22. The cassette loading unit 16 includes a lid opening means (not shown) for opening and closing the lid 24 and a sheet picking means 28 having suction cups 26 for attracting and removing the stimulable phosphor sheet S from the cassette 14 and also returning the stimulable phosphor sheet S back into the cassette 14 after recorded image information has been read and residual image information has been erased.

The erasing unit 20 and the reading unit 18 are positioned downstream of the sheet picking means 28 and connected thereto by a reciprocating feed system 30. The reciprocating feed system 30 comprises a plurality of roller pairs 32 that make up a vertical feed path extending from the cassette loading unit 16 and a horizontal feed path extending from the lower end of the vertical feed path. The erasing unit 20 is disposed on the vertical feed path. The reading unit 18 is disposed above the horizontal feed path. A laterally sheet shifting unit 33 and the sheet member guide mechanism 21 are disposed in the vicinity of a boundary between the vertical feed path and the horizontal feed path. The erasing unit 20 comprises has a vertical array of erasing light sources 34. The erasing unit 20 may have a single erasing light source, and the erasing light source or sources may extend vertically.

The laterally sheet shifting unit 33 comprises a pair of rollers 36*a*, 36*b* for temporarily gripping the leading end of the stimulable phosphor sheet S in the direction in which it is fed, and a pressing means (not shown) for moving the stimulable phosphor sheet S in a direction transverse to the direction in which the stimulable phosphor sheet S is fed, thereby to laterally position the stimulable phosphor sheet S.

Figure 2:
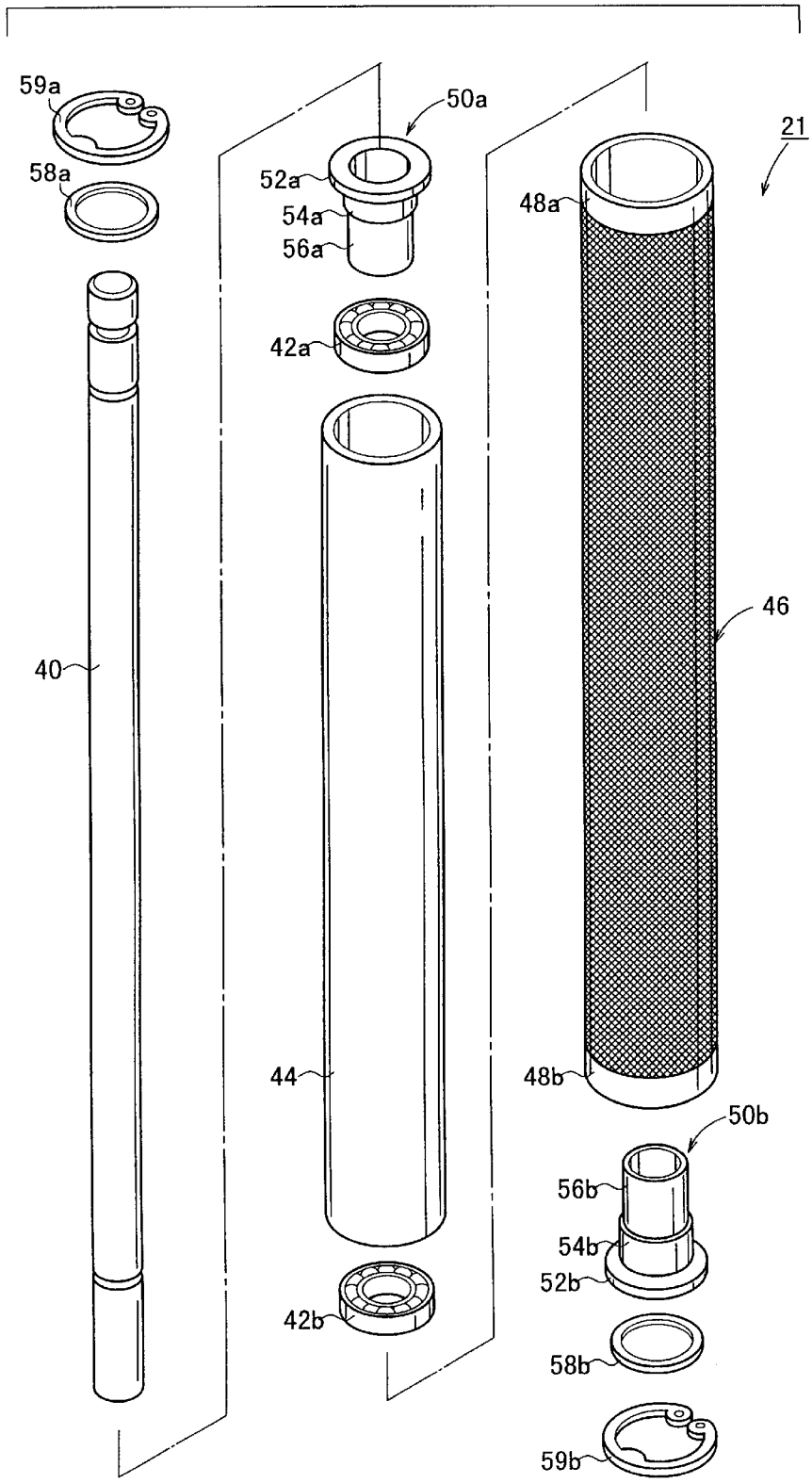
FIG. 2 is an exploded perspective view of the sheet member guide mechanism.
Figure 3:
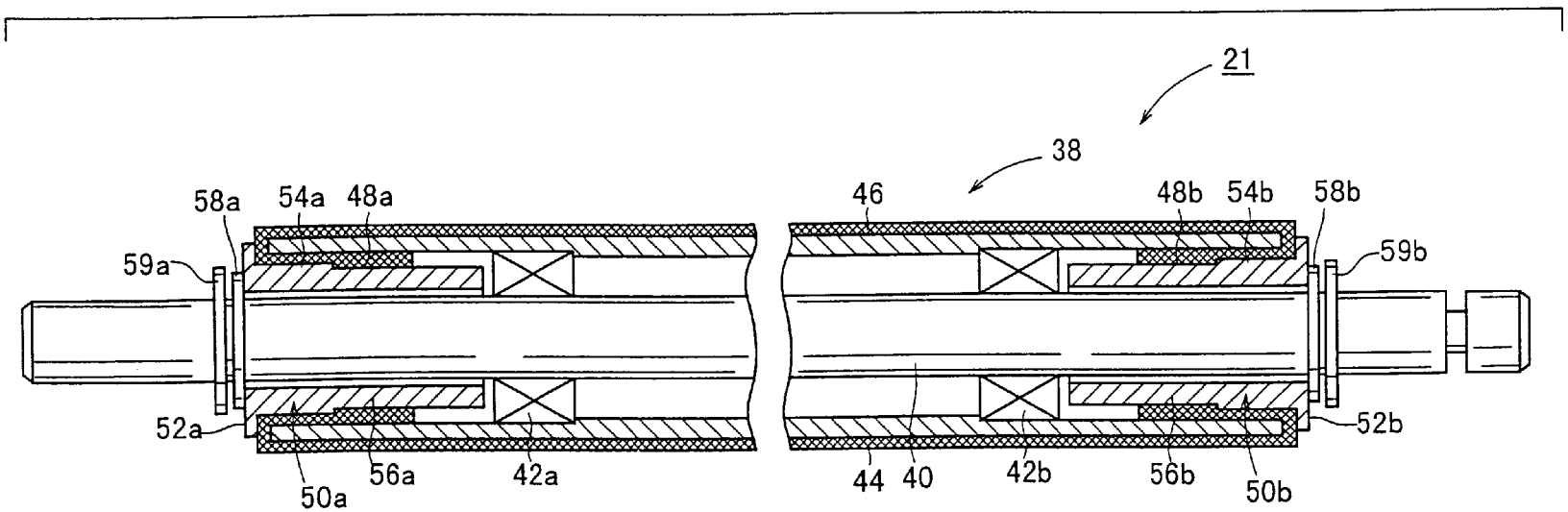
FIG. 3 is a longitudinal cross-sectional view of the sheet member guide mechanism.

As shown in FIGS. 2 and 3, the sheet member guide mechanism 21 has a guide roller 38. The guide roller 38 comprises a hollow roller (roller core) 44 rotatably supported on a shaft 40 by a pair of bearings 42*a*, 42*b*, a woven or knit fabric tube 46 fitted under pressure over the hollow roller 44, and a pair of pressers 50*a*, 50*b* mounted in respective axial ends of the hollow roller 44 to secure ends 48*a*, 48*b* of the fabric tube 46 in the axial ends of the hollow roller 44.

The fabric tube 46 is made of fibers such as nylon filaments which do not damage the stimulable phosphor sheet S and which are woven or knit into a tubular form. Specifically, the fabric tube 46 may be a pipe unit "FJ20PIP" manufactured by Nakamura Sengyo, for example.

The fabric tube 46, which is stretchable and contractible, has an inside diameter smaller than the outside diameter of the hollow roller 44 and an axial length larger than the axial length of the hollow roller 44. However, the fabric tube 46 may have an inside diameter equal to or greater than the outside diameter of the hollow roller 44. At any rate, when the fabric tube 46 is fitted over the hollow roller 44, the fabric tube 46 is pressed against the outer circumferential surface of the hollow roller 44.

The ends 48*a*, 48*b* of the fabric tube 46 are heat-pressed for protection against being unraveled. Therefore, the ends 48*a*, 48*b* of the fabric tube 46 are thicker than the remaining portion of the fabric tube 46.

The pressers 50*a*, 50*b* have respective flanges 52*a*, 52*b*, respective larger-diameter portions 54*a*, 54*b* integrally extending coaxially from the flanges 52*a*, 52*b*, and respective smaller-diameter portions 56*a*, 56*b* integrally extending coaxially from the larger-diameter portions 54*a*, 54*b*. The pressers 50*a*, 50*b* are press-fitted into the respective axial ends of the hollow roller 44 with the smaller-diameter portions 56*a*, 56*b* pressing the thicker ends 48*a*, 48*b* of the fabric tube 46 against inner circumferential surface regions of the hollow roller 44, and the larger-diameter portions 54*a*, 54*b* pressing other portions of the fabric tube 46 against inner circumferential surface regions of the hollow roller 44. Spacers 58*a*, 58*b* are mounted on the shaft 40 against the respective outer axial ends of the pressers 50*a*, 50*b*, and E-rings 59*a*, 59*b* are also mounted on the shaft 40 axially outwardly of the spacers 58*a*, 58*b*.

As shown in FIG. 1, the reading unit 18 has an auxiliary scanning feed mechanism 60 for reciprocally feeding the stimulable phosphor sheet S horizontally in the directions indicated by the arrow X, a laser beam applying mechanism 62 which applies a laser beam L as simulating light vertically downwardly in the direction indicated by the arrow Y to the stimulable phosphor sheet S which is being fed in the auxiliary scanning direction indicated by the arrow X1, and a reading mechanism 64 for collecting light emitted from the stimulable phosphor sheet S to photoelectrically read the radiation image information recorded in the stimulable phosphor sheet S.

The laser beam applying mechanism 62 has an optical system 66 for bending the laser beam L which has been emitted horizontally in a substantially vertically downward direction to apply the laser beam L to the stimulable phosphor sheet S. The reading unit 18 also includes a light guide 68 and a reflecting mirror 70 that are positioned near the area where the laser beam L is applied to the stimulable phosphor sheet S. The light guide 68 serves to collect and guide the light that is emitted from the stimulable phosphor sheet S upon exposure to the laser beam L. The reading unit 18 also has a photomultiplier 72 mounted on the upper end of the light guide 68.

The auxiliary scanning feed mechanism 60 has first and second feed roller pairs 74, 76 for gripping the stimulable phosphor sheet S to feed the stimulable phosphor sheet S in the direction indicated by the arrow X1 (auxiliary scanning direction) and the direction indicated by the arrow X2.

Operation of the image information reading apparatus 10 will be described below with respect to the sheet member guide mechanism 21 according to the present invention.

The cassette 14 is horizontally loaded into the cassette loading unit 16 that is positioned in an upper portion of the apparatus housing 12. The cassette 14 stores therein the stimulable phosphor sheet S with the radiation image information of a subject such as a human body being recorded thereon. The lid 24 of the loaded cassette 14 is opened by the lid opening/closing means (not shown) in the cassette loading unit 16.

Then, the sheet picking means 28 is actuated to move the suction cups 26 into the cassette 14, and the suction cups 26 attract a surface (reverse surface) of the stimulable phosphor sheet S in the cassette 14. The suction cups 26 which have attracted the stimulable phosphor sheet S are moved from within the cassette 14 toward the reciprocating feed system 30, thus removing the stimulable phosphor sheet S from the cassette 14. Substantially at the same time that the leading end of the stimulable phosphor sheet S removed from the cassette 14 is gripped by the first roller pair 32, the suction cups 26 release the stimulable phosphor sheet S.

The roller pairs 32 are rotated to feed the stimulable phosphor sheet S horizontally and then vertically downwardly along the vertical feed path of the reciprocating feed system 30. After the stimulable phosphor sheet S has passed through the erasing unit 20, the stimulable phosphor sheet S is fed into the laterally sheet shifting unit 33. The laterally sheet shifting unit 33 laterally positions the stimulable phosphor sheet S laterally, i.e., in a direction perpendicular to the direction in which the stimulable phosphor sheet S is fed. Thereafter, the rollers 36*a*, 36*b* are moved away from each other, and the leading end of the stimulable phosphor sheet S is fed to the auxiliary scanning feed mechanism 60 of the reading unit 18.

In the auxiliary scanning mechanism 60, the stimulable phosphor sheet S is gripped by the first and second roller pairs 74, 76 and fed horizontally in the auxiliary scanning direction indicated by the arrow X1. At the same time, the laser beam L is emitted from the laser beam applying mechanism 62. The laser beam L first travels horizontally and then is directed downwardly as indicated by the arrow Y by the optical system 66. The laser beam L is applied to the recording surface of the stimulable phosphor sheet S to scan the stimulable phosphor sheet S in a main scanning direction. In response to the application of the laser beam L, the recording surface of the stimulable phosphor sheet S emits light representing the recorded radiation image information. The emitted light is applied to the light guide 68 directly or by the reflecting mirror 70, and then guided by the light guide 68 to the photomultiplier 72, which photoelectrically reads the radiation image information based on the light.

Figure 4:
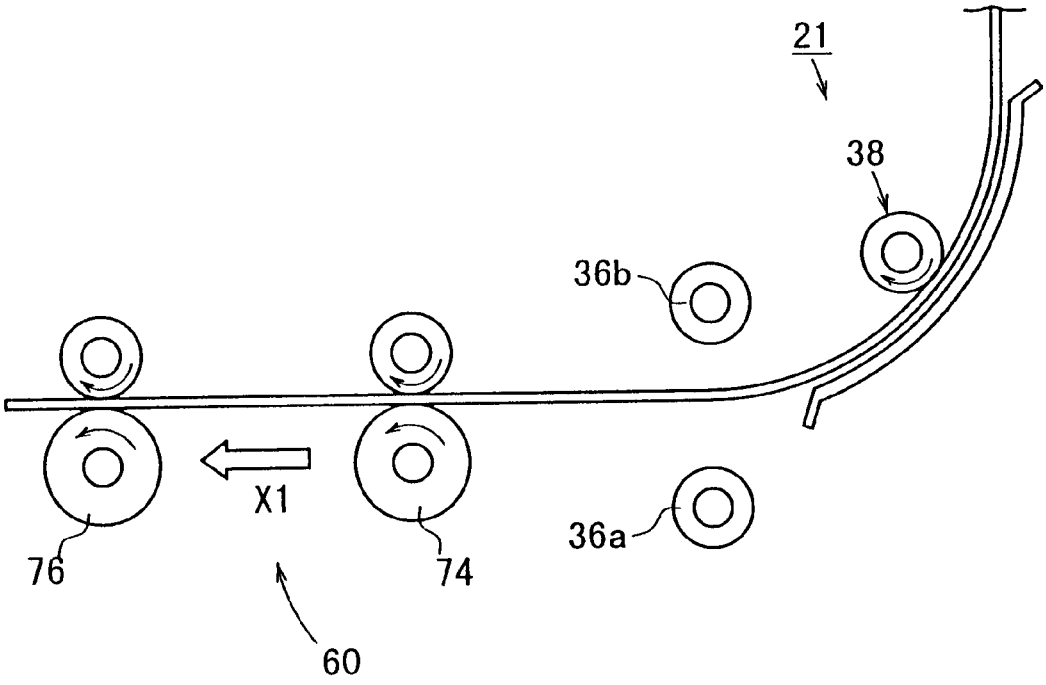
FIG. 4 is an elevational view showing the manner in which the sheet member guide mechanism operates when the image information reading apparatus is scanning a sheet member.

As shown in FIG. 4, the recording surface of the stimulable phosphor sheet S is guided in contact with the guide roller 38 of the sheet member guide mechanism 21. As shown in FIG. 3, the fabric tube 46 is fitted under pressure over the hollow roller 44 of metal. The fabric tube 46 is held in direct contact with the stimulable phosphor sheet S, and the hollow roller 44 with the fabric tube 46 fitted thereover is rotated around the shaft 40 by the bearings 42*a*, 42*b* as the stimulable phosphor sheet S moves.

Since the fabric tube 46 is woven or knit of nylon filaments or the like, there is no joint formed in the outer circumferential surface of the fabric tube 46, and hence the fabric tube 46 held against the stimulable phosphor sheet S does not cause damage to the stimulable phosphor sheet S.

As described above, the fabric tube 46 is fitted under pressure over the hollow roller 44. Specifically, if the inside diameter of the fabric tube 46 is smaller than the outside diameter of the hollow roller 44, then when the hollow roller 44 is axially pushed into the fabric tube 46, the fabric tube 46 is press-fitted over the hollow roller 44. After the axial ends of the fabric tube 46 are pushed into the respective axial ends of the hollow roller 44, the pressers 50*a*, 50*b* are pressed into the axial ends of the hollow roller 44. The ends 48*a*, 48*b* of the fabric tube 46 are thus held in the respective axial ends of the hollow roller 44 by the pressers 50*a*, 50*b*.

Alternatively, if the inside diameter of the fabric tube 46 is equal to or greater than the outside diameter of the hollow roller 44 and the axial length of the fabric tube 46 is the same as the axial length of the hollow roller 44, then the ends 48*a*, 48*b* of the fabric tube 46 are forcibly pulled apart and pushed into the respective axial ends of the hollow roller 44, and then the pressers 50*a*, 50*b* are pressed into the respective axial ends of the hollow roller 44. Since the fabric tube 46 is contracted radially inwardly by being axially pulled, the fabric tube 46 is press-fitted over the hollow roller 44.

At any rate, the fabric tube 46 is not required to be attached to the hollow roller 44 by an adhesive tape or the like, and the guide roller 48 can be assembled highly efficiently.

The hollow roller 44 is rotatably supported on the shaft 40 by the bearings 42*a*, 42*b*. Therefore, even when foreign deposits such as dust particles are applied to the fabric tube 46, since the fabric tube 46 does not slide against the stimulable phosphor sheet S, the recording surface (phosphor layer) of the stimulable phosphor sheet S is effectively prevented from being damaged by those foreign deposits.

As the ends 48*a*, 48*b* of the fabric tube 46 are held within the respective axial ends of the hollow roller 44, the ends 48*a*, 48*b* are not exposed out of the hollow roller 44 and hence are not brought into sliding contact with the stimulable phosphor sheet S. Therefore, fibers such as nylon filaments are prevented from being unraveled from the ends 48*a*, 48*b* of the fabric tube 46. Furthermore, since the ends 48*a*, 48*b* are made thicker by heat-pressing, they are effectively prevented from being displaced out of the hollow roller 44 when the pressers 50*a*, 50*b* are pressed into the axial ends of the hollow roller 44.

The pressers 50*a*, 50*b* may not be pressed into the axial ends of the hollow roller 44, but may be fixed to the axial ends of the hollow roller 44 by an adhesive, for example.

After the radiation image information has been read from the stimulable phosphor sheet S, the auxiliary scanning feed mechanism 60 is reversed to feed the stimulable phosphor sheet S back to the reciprocating feed system 30. At this time, the stimulable phosphor sheet S is guided by the guide roller 38 of the sheet member guide mechanism 21, and the guide roller 38 operates in the same manner as described above.

The stimulable phosphor sheet S is fed upwardly as indicated by the arrow A through the reciprocating feed system 30 into the erasing unit 20. In the erasing unit 20, the erasing light sources 34 are energized to remove residual radiation image information from the stimulable phosphor sheet S. Thereafter, the stimulable phosphor sheet S is returned into the cassette 14, and the lid 24 is closed. The cassette 14 is unloaded from the cassette loading unit 16, and then the stimulable phosphor sheet S is processed to record next radiation image information.

In the present embodiment, the sheet member guide mechanism 21 is disposed near the laterally sheet shifting unit 33 and downstream of the reading unit 18. The sheet member guide mechanism 21 may include a guide roller 38 positioned at a curved feed path between the vertical and horizontal feed paths of the reciprocating feed system 30. If a double-side-readable stimulable phosphor sheet is used for mammography or the like, then the sheet member guide mechanism 21 should preferably be positioned in a required region on the feed paths in order to prevent damage to both surfaces of the stimulable phosphor sheet.

The guide roller 38 includes the hollow roller 44 rotatably supported on the shaft 40 and the fabric tube 46 fitted over the hollow roller 44. The guide roller 38 may be constructed as a drive roller which is driven to rotate. In such a modification, the fabric tube 46 is fitted under pressure over a solid roller (roller core) that is connected to a rotary drive source, and ring-shaped grooves are defined in respective ends of the drive roller out of its shank, with the pressers 50*a*, 50*b* pressed or bonded into the ring-shaped grooves.

With the sheet member guide mechanism according to the present invention, since the fabric tube is fitted under pressure over the roller core, no joint is formed in the fabric tube, and the fabric tube does not need to be attached to the roller core by an adhesive tape or the like. The sheet member guide mechanism is thus capable of preventing damage to the sheet member, and the guide roller can be assembled highly efficiently.

Although a certain preferred embodiment of the present invention has been shown and described in detail, it should be understood that various changes and modifications may be made therein without departing from the scope of the appended claims.

What is claimed is:

1. A sheet member guide mechanism comprising:

a guide roller for guiding a sheet material;

said guide roller comprising:

a roller core; and a fabric tube fitted under pressure over said roller core; and a pair of pressers mounted respectively in axial ends of said roller core to hold and secure respective ends of said fabric tube in the axial ends of said roller core, wherein ends of said fabric tube are made thicker than the remaining portion of said fabric tube by heat pressing, and said pressers have respective larger-diameter portions for pressing said ends of said fabric tube and respective smaller diameter portions for pressing said remaining portion of said fabric tube.

2. A sheet member guide mechanism according to claim 1, wherein said roller core comprises a hollow roller, further comprising a shaft on which said hollow roller is rotatably supported by a pair of bearings.

3. A sheet member guide mechanism according to claim 1, wherein the axial length of said fabric tube is longer than the axial length of said roller core.

4. A sheet member guide mechanism according to claim 1, further comprising a pair of spacers coupled to said pair of pressers.

* * * * *